United States Patent [19]

Miller

[11] 4,285,560

[45] Aug. 25, 1981

[54] ANTI-RACKING DEVICE

[75] Inventor: Norman Miller, Lafayette, Ind.

[73] Assignee: Schwab Safe Co., Inc., Lafayette, Ind.

[21] Appl. No.: 77,918

[22] Filed: Sep. 24, 1979

[51] Int. Cl.[3] ..... A47B 88/00; F16C 21/00

[52] U.S. Cl. ..... 312/331; 312/332; 312/348; 312/110; 108/87; 308/3.8

[58] Field of Search ..... 312/110, 331–333, 312/341 R, 345, 348; 308/3.6, 3.8; 108/87

[56] References Cited

U.S. PATENT DOCUMENTS

| | | | |
|---|---|---|---|
| 3,488,097 | 1/1970 | Fall | 312/348 |
| 3,687,505 | 8/1972 | Fall et al. | 312/331 |
| 3,857,618 | 12/1974 | Hagen et al. | 312/331 |
| 3,901,564 | 8/1975 | Armstrong | 312/332 |
| 3,912,341 | 10/1975 | Stein | 312/331 |

*Primary Examiner*—Victor N. Sakran

*Attorney, Agent, or Firm*—Cushman, Darby & Cushman

[57] ABSTRACT

An anti-racking device for a lateral file cabinet including conventional slides mounted at the bottom and along each side edge of the drawer. The slides are mounted to the cabinet frame by the vertical and horizontal flanges of an L-shaped bracket which is mounted to the side panels of the cabinet by single screw mountings so that the bottom slides may move vertically to compensate for manufacturing tolerances and future wear.

6 Claims, 2 Drawing Figures

ANTI-RACKING DEVICE

BACKGROUND OF THE INVENTION

This invention relates to drawer slides and more particularly to a novel drawer slide assembly having an anti-racking device for use in lateral file cabinets.

Prior lateral file cabinets, i.e., file cabinets which have drawers which are wider than they are deep, are particularly susceptible to racking. When the drawer is pushed in or out there is a tendency for one side to extend further into the cabinet than the other, and in such instances the slide members can bind up so that the drawer does not slide easily. In order to prevent this phenomenon, a number of anti-racking systems have been utilized. For example, cables have been used to connect two side slides of the drawer together so that any inward or outward force on one side of the drawer is transmitted equally to the other side. Such systems are also used on drafting boards to prevent one side from getting ahead of the other. U.S. Pat. Nos. 3,687,505 and 3,385,639 show such devices. Other anti-racking systems utilize rod and gear arrangements across the back of the drawer to accomplish the same result.

Problems with racking are particularly acute in heavy insulated lateral filing cabinets. In such cabinets it is particularly important that the anti-racking device be strong and resistant to wear because of the shocks it can receive from the sudden movements of a heavy drawer. Cables and roller arrangements and rod and gear arrangements are less suitable as anti-racking devices in such cabinets since by their nature they are relatively delicate devices which are susceptible to damage from continuous use, are relatively complex and must be installed with precision.

It is therefore a principal object of the present invention to overcome these disadvantages with relatively simple and strong anti-racking device which is effective, easy and inexpensive to install and resistant to wear.

BRIEF SUMMARY OF THE INVENTION

In accordance with the present invention, conventional slides are mounted between the sides of the drawer and the sides of the cabinet, and an additional slide is mounted between the bottom of the drawer and the drawer's base support in the cabinet adjacent to and at an 90° angle to one of the side slide.

An important feature of the invention is the particular placement of the bottom slide at the bottom of the drawer. It has been determined that two slides mounted at 90° to each other will tend to bind up as they are extended unless they are mounted with very close tolerances to each other. This problem is overcome in the present invention by mounting the bottom slide adjacent to one of the sides of the drawer and cabinet, as by a precision formed bracket which is mounted to the adjacent slides.

In accordance with another feature of the invention, the bottom slide is attached to the precision formed bracket by a single screw located at the extreme innermost end of the bottom slide. The bottom slide is further restrained from lateral movement by vertical tabs in the precision formed brackets which are located at either side of the bottom slide. In this way the bottom slide is able to move a slight amount in the vertical direction as the drawer is extended from the cabinet. This feature allows for variations in manufacturing tolerances of the slides and cabinet and drawer walls, and future slide wear.

The provision of an extra bottom slide is a stronger and simpler means for preventing racking than are previous anti-racking systems.

BRIEF DESCRIPTION OF THE DRAWINGS

Further features and advantages of the invention will be apparent from the following detailed description of the preferred embodiment of the invention when taken with the drawings in which.

DETAILED DESCRIPTION OF THE PREFERRED EMBODIMENT

Figure 1:
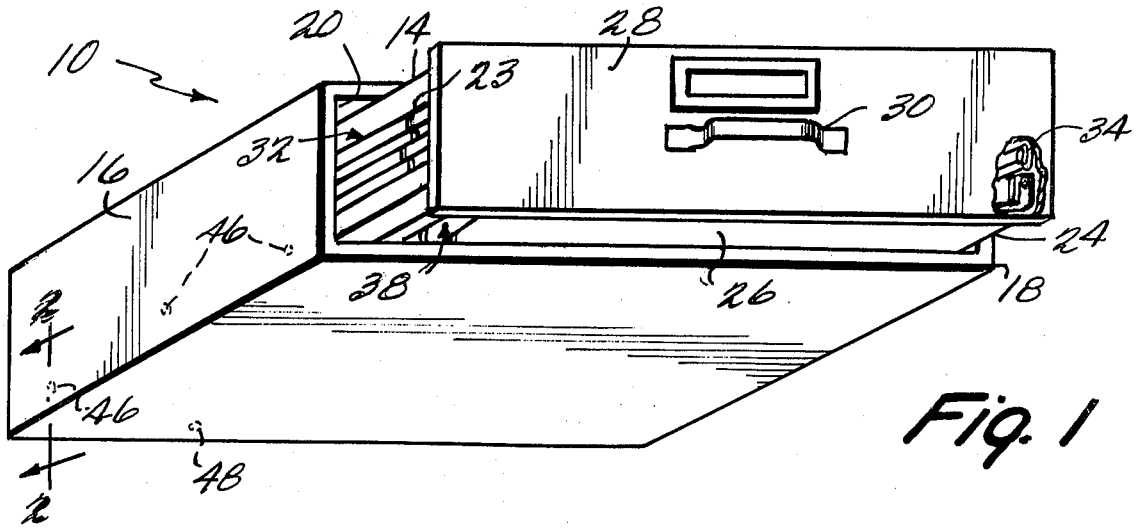
FIG. 1 is a perspective schematic of a lateral file cabinet which includes the anti-racking device of the present invention.

Referring first to FIG. 1, there is shown a lateral file cabinet 10 including a frame 12 and drawer 14. Frame 12 has side panels 16 and 18 and connecting top and base panels 20 and 22. Drawer 14 includes side walls 23 and 24, a base 26 and a front panel 28 having a handle 30. In a lateral file cabinet, the respective frame and drawer have substantially greater width than depth. For example, the cabinet may be 42 inches wide and 20 inches deep. Side slides 32 and 34 are respectively mounted as by screws between frame side panel 16 and drawer side wall 23 and frame side panel 18 and drawer side wall 24. Adjacent to one of the bottom side edges of drawer 14, the left hand edge 36 in this example, is mounted bottom slide 38, as will be described.

Figure 2:
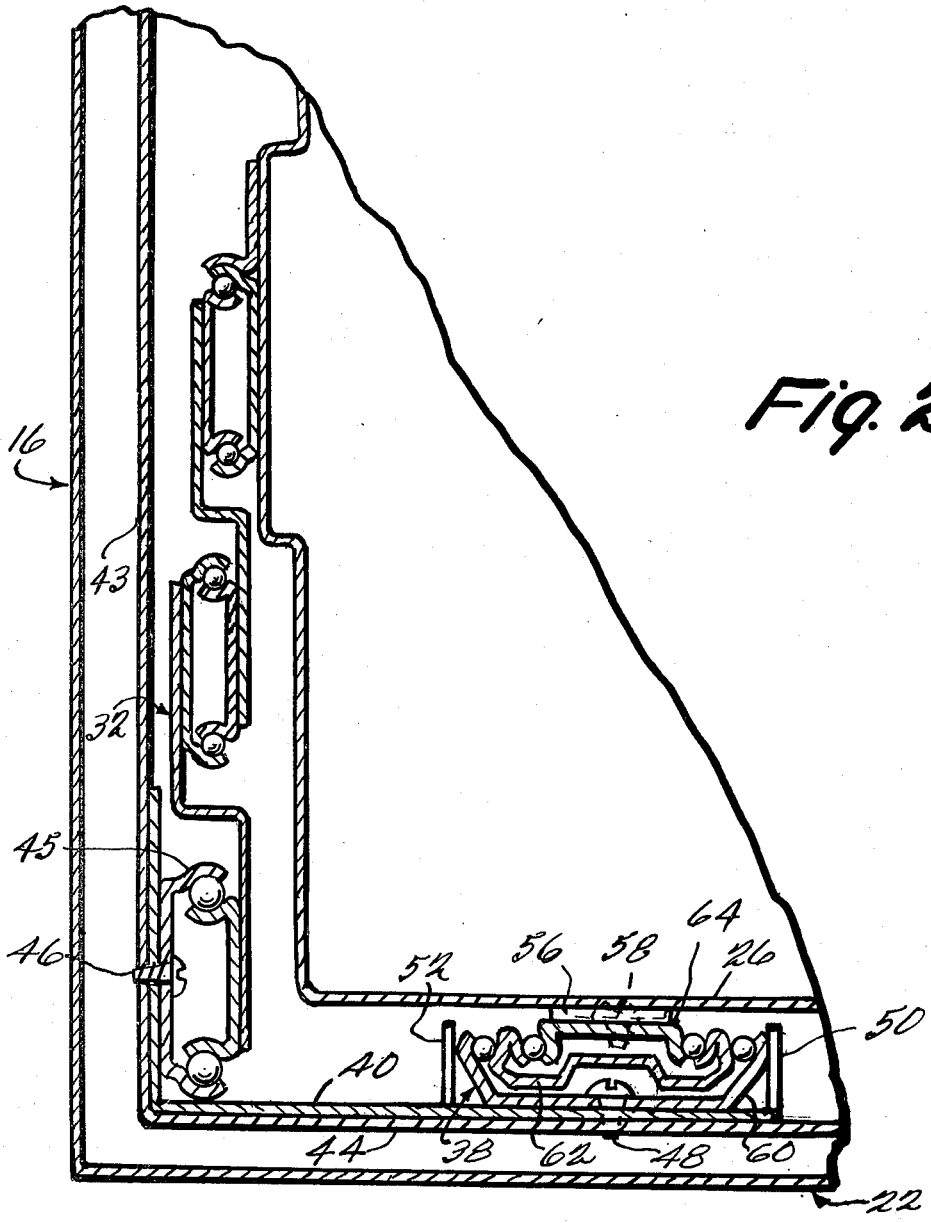
FIG. 2 is a sectional elevation of the anti-racking device of the present invention mounted in the lateral filing cabinet shown in FIG. 1.

Referring to FIG. 2, there is shown a sectional view of side slide 32 and bottom slide 38. Slide 34 is identical to slide 32. Slides 32, 34 and 38 are conventional three-member slides which permit the drawer 14 to be substantially entirely withdrawn from frame 12 while being fully supported thereby.

Slides 32 and 38 are mounted between frame 12 and drawer 14 by an L-shaped precision bracket 40. Bracket 40 should be of rigid construction and is mounted to the frame along its lower inside edge 42 and is welded to the inner shell 43 of side panel 16 and the inner shell 44 of base panel 22 by a resistance-type weld. The side slide channel member 45 used to support the drawer is mounted to the precision formed bracket 40 by three screws 46 (only one being visible in FIG. 2). Bottom anti-rack slide 38 includes a bottom slide member 60, intermediate slide 62 and uppermost slide member 64. The bottom anti-rack slide 38 is mounted to the precision formed bracket 40 by means of one screw 48 located at the extreme innermost end of the bottom slide member 60. The bottom anti-rack slide 38 is restrained from lateral movement by the vertical tabs 50 and 52. The uppermost anti-rack slide member 64 is attached to the drawer bottom 26 in a recessed area 56 by two screws 58 (only one shown in FIG. 2) at the front and rear of drawer 14. This design allows the portion of bottom anti-rack slide 38 forward of screw 48 to flex very slightly in a vertical direction between tabs 50 and 52 as the drawer 14 is extended from the cabinet 12.

It is found that when drawer 14 is inserted into and withdrawn from frame 12, slide 38 operates to maintain alignment and prevent racking without requiring cable and roller arrangements or rod and gear arrangements which have previously been used for this purpose.

Although only one exemplary embodiment of this invention has been described in detail above, those skilled in the art will readily appreciate that many embodiments are possible in the exemplary embodiment without materially departing from the novel teachings and advantages of this invention. For example, any suitable fasting means may be substituted for screws 46, 48 and 58 and slides 32, 34 and 38 may be replaced by other conventional filing cabinet slides. Accordingly, all such modifications are intended to be included within the scope of this invention as defined in the following claims.

What is claimed is:

1. A slide assembly for slidably mounting a drawer having two vertical sides and a horizontal base in a cabinet having side walls and a base support comprising:

an L-shaped bracket having an inner end, a horizontal planar portion and a vertical planar portion joined to said horizontal planar portion along a longitudinal edge;

a first elongated slide mounted to the horizontal portion of said bracket parallel said longitudinal edge;

a second elongated slide mounted to said vertical portion of said bracket parallel said longitudinal edge, said first and second elongated slides each including a first slide member fixedly mounted to said bracket, and a second slide member slidably mounted to said first slide member for movement in a direction parallel said longitudinal edge;

a third elongated slide and means for mounting said third slide between one of said drawer vertical sides and one of said cabinet walls for sliding of said drawer into and out of said cabinet; and means for vertically supporting said bracket in relation to said cabinet and fixing said bracket against longitudinal movement in relation to said cabinet, such that said bracket vertical portion is disposed between the other of said two drawer vertical sides and the other cabinet side wall adjacent said other of said two drawer vertical sides, and said bracket horizontal portion is disposed between said drawer horizontal base and said cabinet base support with said bracket inner end disposed at the inner end of said cabinet;

said bracket longitudinal edge being parallel aligned such that said drawer may be slid into and out of said cabinet on said first, second and third slides, said first slide acting to prevent racking when said drawer is slid in and out of said cabinet.

2. A slide assembly as in claim 1 wherein said first slide member is vertically movable as said drawer is extending from said cabinet.

3. A slide assembly as in claim 1 further comprising means for fastening said first elongated slide to said bracket at said bracket inner end with the portion of said first elongated slide forward of said fastening means being free to flex in a vertical direction relative to said bracket horizontal portion.

4. A slide assembly as in claim 1 or claim 2 wherein said first slide member is fixed rigidly to said drawer horizontal base and said second slide member is fixed rigidly to said drawer vertical sides.

5. A lateral filing cabinet comprising:

at least one lateral filing cabinet drawer having spaced vertical side walls and a horizontal base;

a lateral filing cabinet frame having parallel vertically extending sides, a horizontal base support joined to said sides along horizontal longitudinally extending parallel edges, an opening for receiving said at least one drawer in a horizontal longitudinal direction and an inner end opposite said opening;

first slide means, mounted to each of said sides adjacent said edges, for slidably mounting said drawer in said frame for insertion thereinto and withdrawal therefrom in said longitudinal direction; and second slide means, mounted to said base support adjacent one of said parallel edges and extending parallel said first slide means, for preventing racking when said drawer is slid into and out of said frame;

said first slide means including two first elongated rails respectively fixed in mutually parallel relation to said drawer side wall, respectively adjacent to one and the other of said edges and two first slide members, one for each of said rails, mounted to said rails in sliding relation thereto, said slide members being fastened to said cabinet, an L-shaped bracket mounted to said cabinet along and parallel to one of said parallel cabinet edges, said bracket having a vertical portion mounted against one of said cabinet sides, and a horizontal portion disposed against said base support, said second slide means being mounted to said bracket horizontal portion, one of said first slide members being fixedly mounted to said bracket vertical portion, and said second slide means including a second elongated rail rigidly fastened to said drawer horizontal base adjacet said one edge and a second slide member slidably mounted to said horizontal portion of said bracket and said second elongated rail, said second slide member being fastened to said cabinet frame, and vertically movable in relation to said bracket, said second rail being rigidly fastened to said horizontal base support, and said second slide member being mounted to said horizontal portion of said bracket, said second slide member being vertically movable in relation to said bracket.

6. A slide assembly as in claim 5 wherein said second slide member is fastened to said bracket at a location adjacent the inner end of said cabinet with the portion of said second slide member between said location and said cabinet opening being free to flex in a vertical direction relative to said bracket horizontal portion.

* * * * *